US006880435B2

(12) United States Patent
Hawkins

(10) Patent No.: US 6,880,435 B2
(45) Date of Patent: Apr. 19, 2005

(54) FOLD UP TOOL WITH CENTER BEAM

(75) Inventor: Eric H. Hawkins, Lake Elmo, MN (US)

(73) Assignee: Bicycle Tools Incorporated, St. Paul, MN (US)

( * ) Notice: Subject to any disclaimer, the term of this patent is extended or adjusted under 35 U.S.C. 154(b) by 0 days.

(21) Appl. No.: 10/447,163

(22) Filed: May 27, 2003

(65) Prior Publication Data

US 2004/0237732 A1 Dec. 2, 2004

(51) Int. Cl.[7] ..... B25B 23/00
(52) U.S. Cl. ..... 81/440; 7/138
(58) Field of Search ..... 81/440, 124.5; 7/128, 138

(56) References Cited

U.S. PATENT DOCUMENTS

| | | | | | |
|---|---|---|---|---|---|
| 635,562 | A | | 10/1899 | Marschutz et al. | |
| 1,369,829 | A | | 3/1921 | Minges | |
| 1,398,583 | A | | 11/1921 | Bovee | |
| 2,804,970 | A | | 9/1957 | Kuc | |
| 2,828,855 | A | | 4/1958 | Mosch | |
| 4,238,862 | A | | 12/1980 | Leatherman | |
| 4,327,790 | A | * | 5/1982 | Stevens et al. | 81/177.4 |
| 4,476,751 | A | * | 10/1984 | Mishima | 81/440 |
| 4,744,272 | A | | 5/1988 | Leatherman | |
| 4,815,346 | A | * | 3/1989 | Littlehorn | 81/439 |
| 4,854,045 | A | | 8/1989 | Schaub | |
| 4,888,869 | A | | 12/1989 | Leatherman | |
| 4,908,947 | A | | 3/1990 | Schaub | |
| 5,146,815 | A | | 9/1992 | Scott, III | |
| 5,303,439 | A | | 4/1994 | Seals | |
| 5,313,860 | A | | 5/1994 | Liou | |
| 5,320,004 | A | * | 6/1994 | Hsiao | 81/440 |
| 5,450,774 | A | * | 9/1995 | Chang | 81/440 |
| 5,581,834 | A | * | 12/1996 | Collins | 7/118 |
| 5,588,169 | A | | 12/1996 | Chuang | |
| 5,632,056 | A | | 5/1997 | Hsiao | |
| 5,655,242 | A | | 8/1997 | Chuang | |
| 5,711,042 | A | * | 1/1998 | Chuang | 7/138 |
| 5,711,194 | A | | 1/1998 | Anderson et al. | |
| 5,803,584 | A | * | 9/1998 | Chung | 362/120 |
| D401,133 | S | | 11/1998 | Gardiner et al. | |
| D406,508 | S | | 3/1999 | Rivera | |
| D408,238 | S | | 4/1999 | Rivera | |

(Continued)

*Primary Examiner*—Derris H. Banks
*Assistant Examiner*—Ali Abdelwahed
(74) *Attorney, Agent, or Firm*—Larkin Hoffman Daly & Lindgren Ltd.; Thomas J. Oppold

(57) ABSTRACT

A compact, folding, toolkit includes a central elongate member having a first end and a second end, a left side and a right side; a first tool set pivotally engaging the first end and rotating between a folded position and an extended position along the left side and right side of the central elongate member; and a second tool set pivotally engaging the second end and rotating between a folded position and an extended position along the left side and the right side of the central elongate member.

9 Claims, 3 Drawing Sheets

U.S. PATENT DOCUMENTS

| | | | | | |
|---|---|---|---|---|---|
| D410,369 | S | | 6/1999 | Yeh | |
| 6,014,787 | A | | 1/2000 | Rivera | |
| D420,874 | S | | 2/2000 | Berg et al. | |
| D421,377 | S | | 3/2000 | Rivera | |
| D423,214 | S | | 4/2000 | Hawkins et al. | |
| 6,047,426 | A | | 4/2000 | McIntosh et al. | |
| 6,065,213 | A | | 5/2000 | Rivera | |
| D427,496 | S | | 7/2000 | Berg | |
| D427,501 | S | | 7/2000 | Berg et al. | |
| D427,868 | S | | 7/2000 | Rivera | |
| 6,092,444 | A | * | 7/2000 | Hsiao | 81/440 |
| D428,791 | S | | 8/2000 | Anderson | |
| D429,131 | S | | 8/2000 | Rivera | |
| D429,132 | S | | 8/2000 | Rivera | |
| D429,616 | S | | 8/2000 | Rivera | |
| D429,621 | S | | 8/2000 | Rivera | |
| D429,989 | S | | 8/2000 | Rivera | |
| 6,112,351 | A | * | 9/2000 | Hawkins et al. | 7/138 |
| 6,128,805 | A | | 10/2000 | Rivera | |
| 6,128,981 | A | * | 10/2000 | Bondhus et al. | 81/440 |
| D433,902 | S | | 11/2000 | Rivera | |
| 6,161,273 | A | | 12/2000 | Rivera et al. | |
| D436,514 | S | | 1/2001 | Rivera | |
| 6,216,301 | B1 | | 4/2001 | Rivera | |
| 6,220,127 | B1 | | 4/2001 | Berg et al. | |
| RE37,210 | E | * | 6/2001 | Chuang | 7/138 |
| 6,286,168 | B1 | * | 9/2001 | Woodruff et al. | 7/138 |
| 6,564,678 | B1 | * | 5/2003 | Wang | 81/124.4 |
| 6,601,481 | B1 | * | 8/2003 | Chuang | 81/440 |
| 6,622,329 | B1 | * | 9/2003 | Ostor et al. | 7/138 |
| 2003/0074738 | A1 | * | 4/2003 | Chuang | 7/100 |

* cited by examiner

FOLD UP TOOL WITH CENTER BEAM

BACKGROUND OF THE INVENTION

This invention relates to hand tools and more particularly to a multipurpose tool kit. The present invention is a compact tool kit that is easily carried. While the toolkit can be used for bicycle repair and maintenance, it is also useful for any other application requiring a compact, multipurpose tool kit.

Bicycles have long been plagued with the problem of minor breakdowns occurring while riding when they are far from help or access to repair equipment. Because of the excess weight and limited storage space, conventional tools are seldom transported along with the bike for repair and adjustment purposes. The majority of problems occurring on conventional bicycles can be fixed or adjusted with only a few specific tools. Combining these specific tools into one lightweight compact unit would be particularly useful to the rider.

There is a need for a compact, folding, bicycle tool kit that has the minimum tools needed for bicycle repair and also has a slim profile for carriage in a small enclosure such as a pouch or pocket.

SUMMARY OF THE INVENTION

A compact, folding, toolkit, comprising:

(a) a central elongate member having a first end and a second end, a left side and a right side;

(b) a first tool set pivotally engaging the first end and rotating between a folded position and an extended position along the left side and right side of the central elongate member; and (c) a second tool set pivotally engaging the second end and rotating between a folded position and an extended position along the left side and the right side of the central elongate member.

An object and advantage of the present invention is that it has the minimum set of tools needed for bicycle repair.

An object and advantage of the present invention is that it has a slim profile for carriage in a small enclosure such as a pouch or pocket.

DETAILED DESCRIPTION OF THE PREFERRED EMBODIMENT

Figure 1:
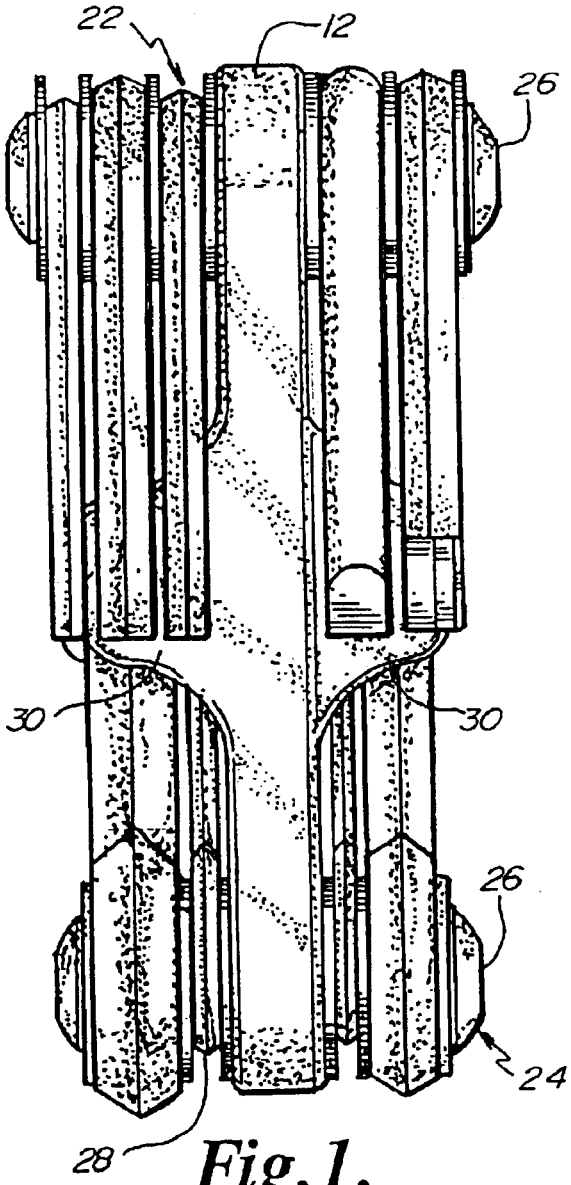
FIG. 1 is a top plan view of the present invention.
Figure 2:
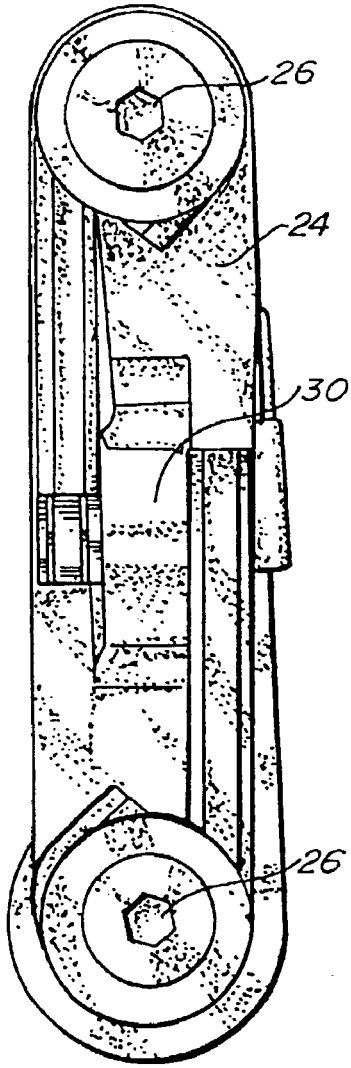
FIG. 2 is a right-side view of the present invention.
Figure 3:
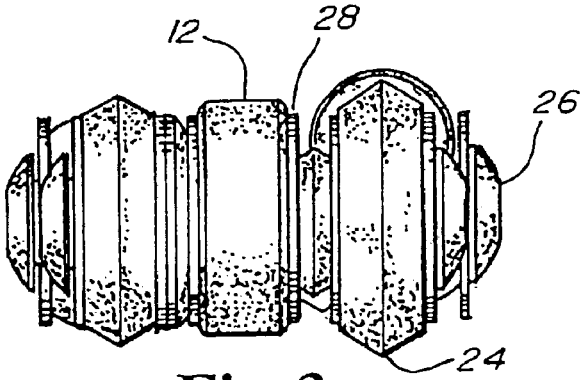
FIG. 3 is an end view of the present invention.
Figure 4:
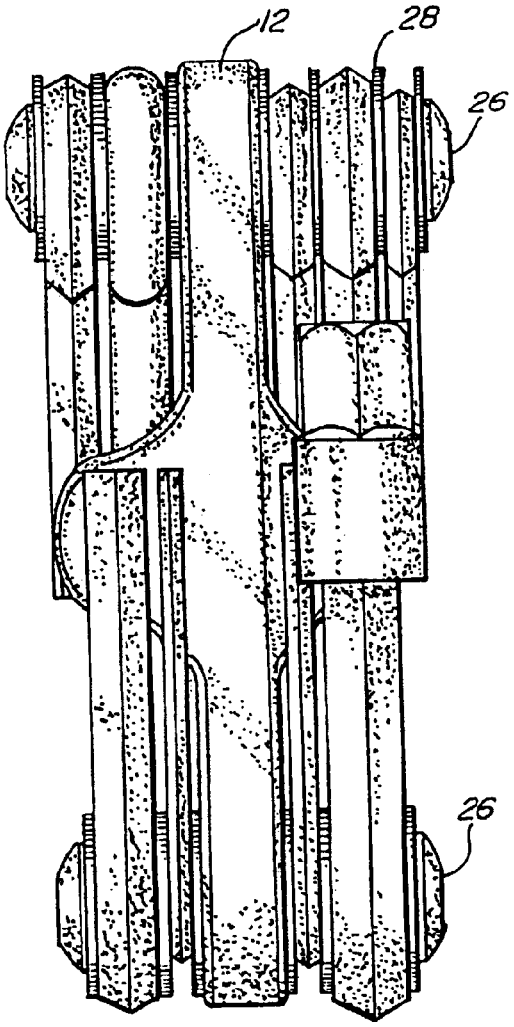
FIG. 4 is a bottom plan view of the present invention.
Figure 5:
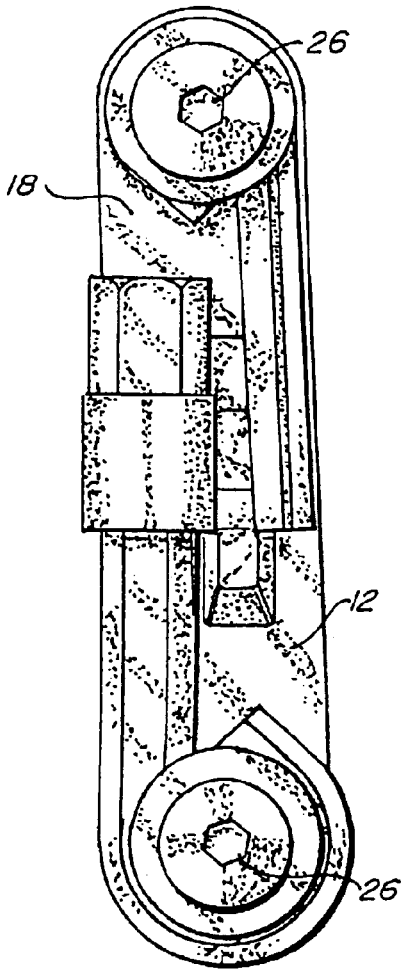
FIG. 5 is a left side view of the present invention.
Figure 6:
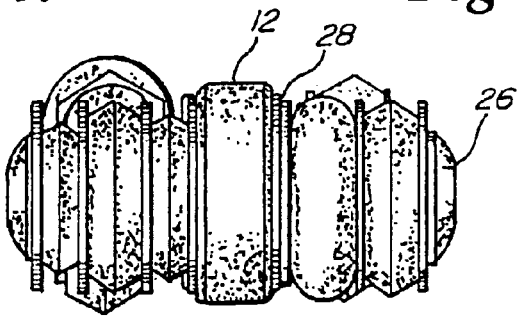
FIG. 6 is an end view of the present invention.

As shown in the Figures, the present invention comprises a compact, folding, toolkit 10, comprising:

a central elongate member 12 having a first end 14 and a second end 16, a left side 18 and a right side 20;

a first tool set 22 pivotally engaging the first end 14 and rotating between a folded position (FIG. 7) and an extended position (FIG. 8) along the left side 18 and right side 20 of the central elongate member 12; and a second tool set 24 pivotally engaging the second end 16 and rotating between a folded position (FIG. 7) and an extended position (FIG. 8) along the left side 18 and right side 20 of the central elongate member 12.

In one embodiment, the first tool set 22 and second tool set 24 rotate on pivot pins 26 traversing the central elongate member 12 from the right side 20 to the left side 18.

In one embodiment, the invention 10 further comprises washers 28 on the pivot pins 26, the washers 28 separating the tools of the first tool set 22 and second tool set 24 from one another.

Figure 7:
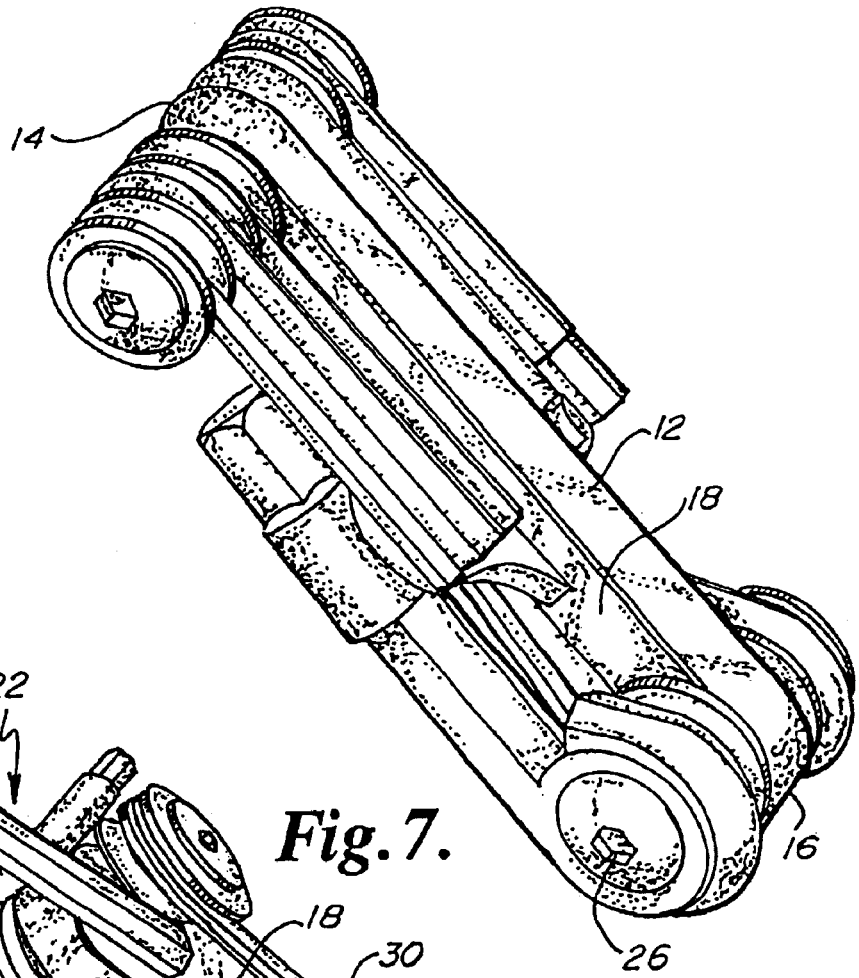
FIG. 7 is a perspective view of the present invention with the tool sets in the folded position.
Figure 8:
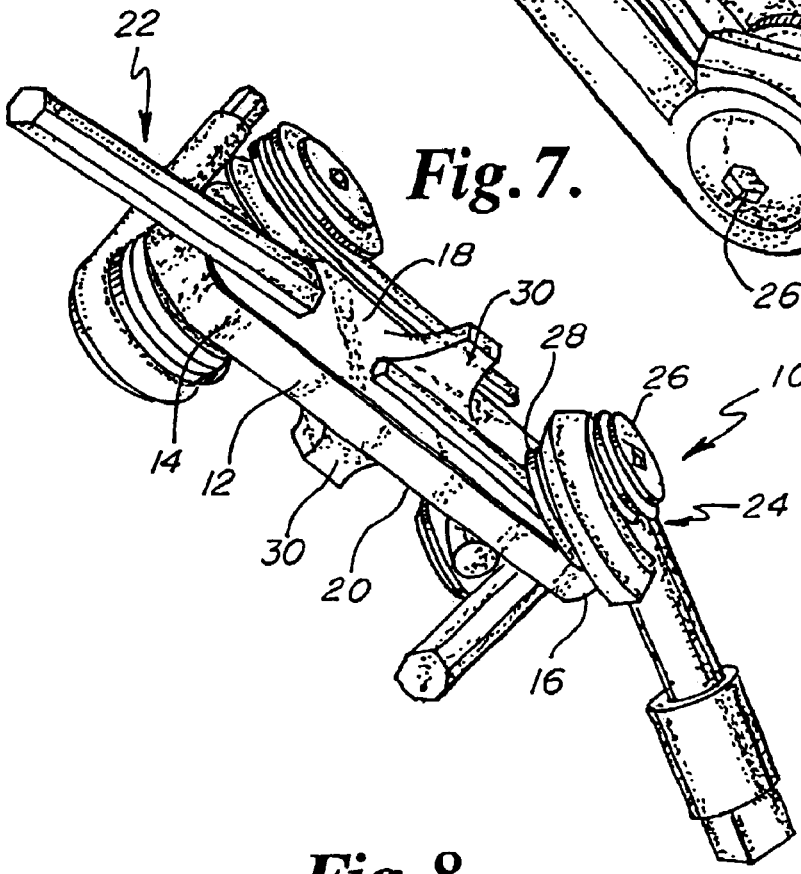
FIG. 8 is a perspective view of the present invention with the tool sets in the extended position.

In one embodiment, the invention 10 further comprises stops 30 formed in the central elongate member 12 and receiving the first tool set 22 and the second tool set 24 in the folded position (FIG. 7).

In one embodiment, the stops 30 extend substantially perpendicularly from the right side 20 and the left side 18.

In one embodiment, the stops 30 are positioned substantially midway between the first end 14 and the second end 16.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A compact, folding, toolkit, comprising:

(a) a central elongate member having a first end and a second end, a left side and a right side;

(b) a first tool set pivotally engaging the first end and rotating between a folded position and an extended position along the left side and right side of the central elongate member;

(c) a second tool set pivotally engaging the second end and rotating between a folded position and an extended position along the left side and the right side of the central elongate member; and (d) stops formed in the central elongate member and receiving the first tool set and second tool set in the folded position; and wherein the stops extend substantially perpendicular from the right side and the left side.

2. The tool kit of claim 1, wherein the first tool set and the second tool set rotate on pivot pins traversing the central elongate member from the right side to the left side.

3. The tool kit of claim 2, further comprising washers on the pivot pins, the washers separating the first tool set and the second tool set from one another.

4. The tool kit of claim 1, wherein the stops are positioned substantially midway between the first end and the second end.

5. The tool kit of claim 1, wherein the first tool set and the second tool set further comprise bicycle repair tools.

6. A compact, folding, toolkit, comprising:

(a) a central elongate member having a first end and a second end, a left side and a right side;

(b) a first tool set pivotally engaging the first end and rotating between a folded position and an extended position along the left side and right side of the central elongate member;

(c) a second tool set pivotally engaging the second end and rotating between a folded position and an extended position along the left side and the right side of the central elongate member; and (d) stops formed in the central elongate member and receiving the first tool set and second tool set in the folded position, wherein the stops extend substantially perpendicularly from the right side and the left side, and wherein the stops are positioned substantially midway between the first end and the second end.

7. The tool kit of claim 6, wherein the first tool set and the second tool set rotate on pivot pins traversing the central elongate member from the right side to the left side.

8. The tool kit of claim 7, further comprising washers on the pivot pins, the washers separating the first tool set and the second tool set from one another.

9. The tool kit of claim 6, wherein the first tool set and the second tool set further comprise bicycle repair tools.

* * * * *